United States Patent [19]

Morrison

[11] Patent Number: 4,573,437

[45] Date of Patent: Mar. 4, 1986

[54] SELF-PROPELLED VEHICLE

[76] Inventor: Ronald D. Morrison, 7836 Jasper Ave., Edmonton, Alberta T5H 3R9, Canada, T5H 3R9

[21] Appl. No.: 654,397

[22] Filed: Sep. 26, 1984

Related U.S. Application Data

[63] Continuation-in-part of Ser. No. 558,831, Dec. 7, 1983, Pat. No. 4,478,179.

[51] Int. Cl.[4] ..... F02R 57/08

[52] U.S. Cl. ..... 123/44 B; 123/43 C

[58] Field of Search ..... 123/44 R, 44 A, 44 B, 123/44 E, 43 R, 43 C, 55 A

[56] References Cited

U.S. PATENT DOCUMENTS

| | | | |
|---|---|---|---|
| 1,037,401 | 9/1912 | Youngren | 123/44 B |
| 1,210,409 | 1/1917 | Brooke | 123/44 R |
| 1,716,711 | 6/1929 | Southern | 123/43 R |
| 4,478,179 | 10/1984 | Morrison | 123/44 B |
| 4,530,316 | 7/1985 | Morrison | 123/44 R |

FOREIGN PATENT DOCUMENTS

| | | | |
|---|---|---|---|
| 9525 | of 1913 | United Kingdom | 123/44 B |

*Primary Examiner*—Magdalen Y. C. Moy

*Attorney, Agent, or Firm*—Sim & McBurney

[57] ABSTRACT

A self-propelled vehicle includes a body and a set of four internal-force generating devices, in the form of radial piston engines. Each device has a central axis about which some internal portions rotate. The four devices are configured in two opposed pairs, the two devices of one pair having parallel axes but turning in opposite directions, the two devices of the other pair also having parallel axes but turning in opposite directions. The axes of one pair are at right angles to the axes of the other pair. Each device provides an eccentric orbit for each of three pistons about a central axis the piston cylinders being defined by a rotor which rotates uniformly about that axis. As a result, the angular momentum and resulting centrifugal effect generated within each cylinder at its furthest displacement from the axis is significantly greater than the angular momentum and centrifugal effect when it is at its closest approach. The difference in these two effects is utilized to generate lift.

12 Claims, 4 Drawing Figures

SELF-PROPELLED VEHICLE

This is a continuation-in-part of U.S patent application Ser. No. 558,831, filed on Dec. 7, 1983 and now U.S. Pat. No. 4,478,179, and entitled "IMPROVEMENTS IN RADIAL PISTON ENGINES".

This invention relates generally to self-propelled vehicles, and pertains particularly to such a vehicle which utilizes a plurality, preferably four, of specially designed internal combustion engines which interact in such a way as to produce an internal force at right angles to the axis of rotation of each engine.

Essentially, the engines utilized for the vehicle to which this disclosure is directed will have the same construction as the radial piston engine described in the parent U.S. patent application Ser. No. 558,831.

BACKGROUND OF THIS INVENTION

Theoretical analysis, together with actual observation, appear to confirm that a rotary engine in which certain of the parts follow eccentric orbits with respect to a central axis can take advantage of the centrifugal effects thus generated in such a way that the net force in one direction on the device as whole exceeds the net force in the opposite direction. The vehicle to be disclosed herein is designed to take advantage of this unbalanced force effect in order to produce push or lift which can propel the vehicle.

In addition to the engine described in the parent U.S. patent application Ser. No. 558,831 now U.S. Pat. No. 4,478,179, use may also be made of the earlier version of that engine, described in U.S. patent application Ser. No. 376,695, filed May 10, 1982 and now U.S. Pat. No. 4,530,316, and entitled "IMPROVEMENTS IN INTERNAL COMBUSTION ENGINES".

GENERAL DESCRIPTION OF THIS INVENTION

In view of the foregoing, this invention provides a self-propelled vehicle which includes a body and a set of four internal-force generating devices, each said device having a central axis about which internal portions thereof rotate, the four devices being configured as two opposed pairs, the two devices of one pair having parallel axes but turning in opposite directions, the two devices of the other pair also having parallel axes but turning in opposite directions, the axes of said one pair being at right angles to the axes of said other pair, each device comprising:

stationary frame means, a stationary sun gear on the frame means, the sun gear being coaxial with the central axis of its respective device, a rotor pivoted about the axis of the sun gear, three crankshafts carried by the rotor at substantially 120° intervals, each having an eccentric portion, for each crankshaft a cylinder in the rotor, a piston mounted for reciprocation in each cylinder, and a connecting rod from the piston to the eccentric portion of the crankshaft, each crankshaft being fixed to rotate with a respective planetary gear, all planetary gears meshing with the sun gear and having the same pitch diameter as the sun gear, whereby any point on the pitch circle of a planetary gear describes a cardioid as the planetary gear rotates around the sun gear once, the crankshaft eccentricity being substantially $\frac{1}{3}$ of the pitch radius of a planetary gear, fuel metering means for providing a combustible mixture for the cylinder, ignition means to ignite the combustible mixture in each cylinder, and valve means for admitting the combustible mixture to, and exhausting combustion gases from, each cylinder.

GENERAL DESCRIPTION OF THE DRAWINGS

One embodiment of this invention is illustrated in the accompanying drawings, in which like numerals denote like parts throughout the several views, and in which:

FIGS. 1*a* and 1*b* are left and right halves, respectively, of an axial sectional view through a radial piston engine for use in the vehicle of this invention;

FIG. 2 is a schematic plan view of a self-propelled vehicle, showing the location of the radial piston engines and their mutual configuration; and FIG. 3 is a sectional view taken at the line 3—3 in FIG. 2.

DETAILED DESCRIPTION OF THE DRAWINGS

Figure 1A:
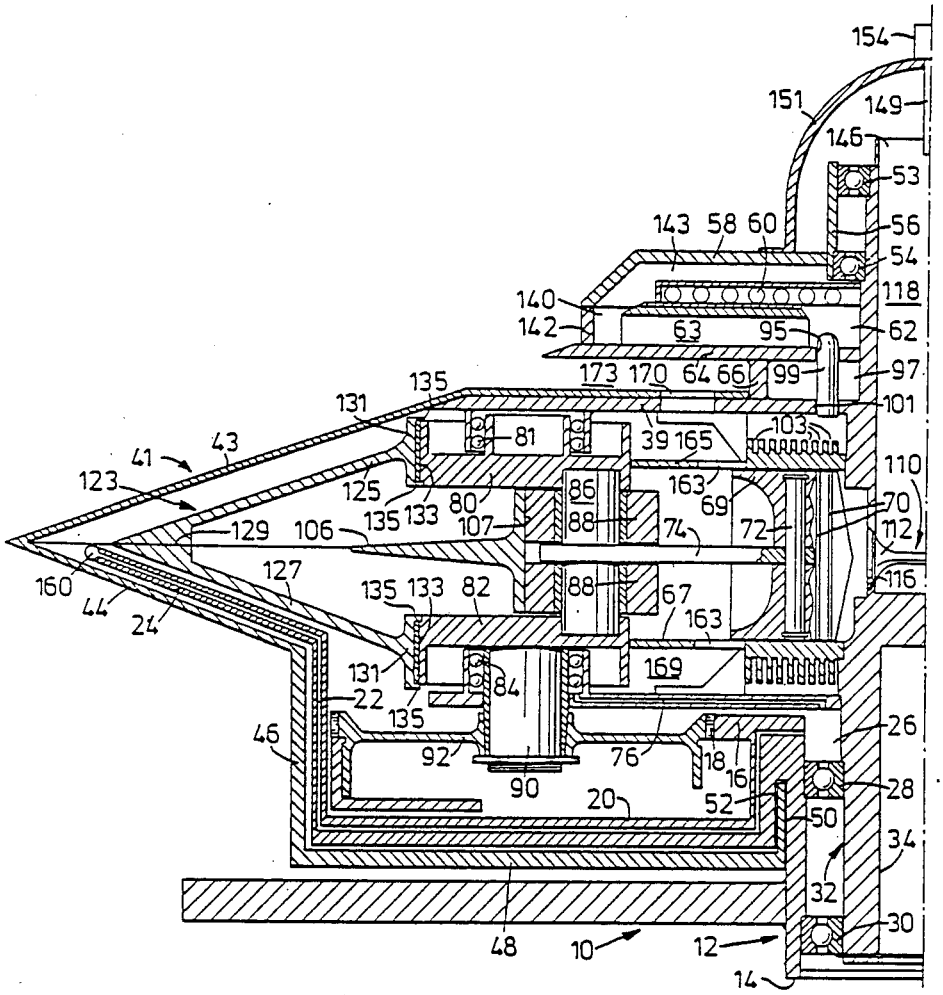

In FIG. 1 (refer to both parts 1*a* and 1*b*), the numeral 10 designates a stationary motor mount which is intended to allow the motor to be mounted to the chassis of a vehicle. Welded to the motor mount 10 is a stationary sleeve 12 having a lower end 14 projecting through the bottom side of the motor mount 10, and having at its upper end an annular flange 16 defining at its outer periphery a sun gear 18.

Fixedly connected to the sleeve 12 is a radially extending plate 20 which joins an axially extending portion 22, which in turn joins an obliquely extending portion 24. The plate 20 and the portions 22 and 24 contain a passage for oil, and allow oil to be returned from the remote end of the portion 24 to the space 26 within the internal surface of the sleeve 12, by a means which will be explained subsequently. The oil returned to the space 26 is available to lubricate two bearings 28 and 30 which are mounted within the sleeve 12 and which mount for rotation the lower end of a rotor 32. The rotor 32 has an internal bore 34 extending axially upwardly from its lower end, in order to reduce its weight. The rotor 32 includes a central thicker portion 36 in which the piston cylinders are provided (as will be hereinafter described). At the upper end of the thicker portion 36, there is secured to the rotor 32, for example by welding, an annular plate 39 which rotates with the rotor. The annular plate 39 supports an outer V-shaped housing member 41, and is secured thereto so that the housing member 41 is a rotating member. More particularly, the housing member 41 includes a first frusto-conical plate 43 which is connected at its outer rim to a second frusto-conical plate 44, the latter being connected at its inner rim to a cylindrical member 46 extending axially downwardly and being connected at its lower edge to an annular plate 48. The annular plate 48 has, at its inner periphery, an upwardly extending sleeve 50, which is received within an appropriate slot 52 in the sleeve 12 without physical contact therewith. It will thus be seen that the rotor 32, the plate 39, the housing member 41, the cylindrical member 46, the plate 48 and the sleeve 50 all rotate together as a unit with respect to the sleeve 12 and the sun gear 18.

At its upper end, the rotor 32 rotates in bearings 53 and 54 which are held in a stationary sleeve 56 fixed in turn to a stationary annular plate 58. It is to be understood that the annular plate 58 is mounted, by means not shown, securely to the chassis of the vehicle.

The numeral 60 represents an air intake manifold which gathers air in from opposite sides of the engine, when seen looking in an axial direction, and delivers the air to an air plenum 62. From the plenum 62, air is urged centrifugally outwardly by a plurality of substantially radially aligned blades 63 which are secured to a rotating plate 64 fixed at its inner end to the rotor 32 and braced by means of a sleeve member 66 with respect to the plate 39. The sleeve member 66 is welded both to the plate 64 and the plate 39.

The thicker portion 36 of the rotor 32 is shaped to define three cylinders at intervals of 120°, one of the cylinders being shown at 67 to the left in the figure. Mounted for reciprocation in each cylinder 67 is a piston 69 which is provided with conventional piston rings 70. The piston 69 has a wrist pin 72 in the usual way, to which a conventional connecting rod 74 is pivoted.

Secured to the rotor 32 at the bottom end of the thicker portion 36 is a further annular plate 76 which, along with plate 39, supports for rotation three crankshafts which are at intervals of 120°.

Looking to the left in the figure, each crankshaft includes a first drum member 80 rotatably mounted to the plate 39 by virtue of bearings 81, and a second drum member 82 rotatably mounted with respect to the plate 76 by virtue of bearings 84. The two drum members 80 and 82 support an eccentric shaft 86 to which the other end of the connecting rod 74 is connected in the usual way. However, it can be seen in the figure that the connecting rod 74 is attached only to the middle portion of the shaft 86. As can be seen, two rollers 88 are also rotatably mounted on the shaft 86, one above and one below the connecting rod 74. The rollers 88 will not undergo any substantial rotation, as will hereinafter appear, and therefore they can be mounted on relatively inexpensive bearings, or simply mounted for a direct slip fit around the shaft 86.

The drum member 82 has an elongated central shaft 90 projecting through the plate 76, and having mounted thereto a planetary gear 92 which meshes with the sun gear 18. The pitch diameter of the planetary gear 92 is the same as the pitch diameter of the sun gear 18, whereby any point on the pitch circle of one of the planetary gears describes a cardioid as the planetary gear rotates around the sun gear once.

Turning briefly to the cooling of the cylinder 67, it will be seen that passages 95 are provided between the plenum 62 and the space 97 within the sleeve 66 and between the plates 39 and 64. Extending into the space 97 are a plurality of directional scoops 99 which communicate through bores 101 in plate 39 with a plurality of air grooves 103 that surround the cylinder 67 for cooling the same.

A ring member 106 is provided, and has an internal surface 107 that surrounds and contacts all of the rollers 88 (for all three of the crankshafts) simultaneously, the ring member being free to rotate about its own axis, and in fact being free of contact with any part of the engine except for the rollers 88. The purpose of the ring member 106 is to absorb the centrifugal load exerted by the piston 69 and the connecting rod 74.

By ensuring that the crankshaft eccentricity, i.e. the distance between the centre of the shaft 86 and the centre of the shaft 90, is $\frac{1}{3}$ times the pitch radius of the planetary gear 92, the locus described by the shaft 86 when seen from a stationary frame of reference is substantially circular. This means that the ring member 106 will always remain substantially in the off-centre position shown in the figure, and will rotate with the rotor 32 at the same speed as the rotor. Because the crankshafts are rotating about their axes with respect to the rotor, the rollers 88 will simply rock back and forth, but will not rotate or spin at high speeds.

By ensuring the presence of an oil film between the surface 107 and the rollers 88, a highly efficient means of absorbing centrifugal loads is provided, without generating any significant heat at the contacting surfaces through friction.

Having now explained that the ring member 106 remains always off centre with respect to the rotor 32, it is appropriate to explain how the valves function which admit a combustible mixture of gases to the cylinders. Looking at the figure, a valve is shown at 110, having a valve head 112 and a valve shaft 114. The valve head 112 engages a valve seat 116, such that when the valve is depressed (moves to the left in the drawing) there is communication between the cylinder 67 and a central bore 118 in the rotor 32. The combustible mixture of gases is present in the bore 118, by means which will be explained subsequently.

As can be seen, the shaft 114 of the valve 110 extends substantially radially with respect to the rotor 32, and has at its end remote from the valve head 112 a roller 120 which is adapted to contact the internal surface 107 of the ring member 106 over a fraction of each rotor revolution, thereby to depress the valve for the admission of the combustible mixture from the bore 118 into the respective cylinder 67. In the figure, the valve 110 is shown at its position 180° rotated from the position in which it is depressed and would admit combustible gases to its respective cylinder. The valve 110 is biased to the closed position due to centrifugal force.

The engine further includes a second ring member 123 which is preferably comprised of two frusto-conical portions 125 and 127, secured together at a joint plane 129, as by welding. At the inner end of each frusto-conical portion 125 and 127 is an enlarged part 131 defining an internal cylindrical surface 133 bordered by inwardly directed ribs 135. The internal cylindrical surfaces 133 engage the outer cylindrical surfaces of all of the drums 80, 82 of the three crankshaft arrangements, as particularly seen at the left in the figure. The second ring member 123 is freely floating within the rotating housing member 41. Because the drums 80 and 82 rotate as the associated planetary gears revolve around the stationary sun gear 18, their outer surfaces move linearly at a faster rate than the rotation of the rotor 32. This in turn will cause the second ring member 123 to rotate at a faster rate than the rotor 32.

The function of the second ring member is to absorb centrifugal loads from the drums 80, 82, which otherwise would have to be taken at the mounting locations for the drums, thus putting excessive loading on the bearings which support the drums.

Returning to the upper portion of the apparatus shown in the figure, it has been explained that the blades 63 rotate with the rotor 32, and cause air reaching the planum 62 to be centrifugally flung outwardly. The air passing off the outer perimeter of the blades 63 reaches a space 140 defined between a rotating cylindrical sleeve 142 and the stationary plate 58. The air in this space is pressurized with respect to atmospheric, and communicates along a passageway 143 with the upper end 146 of the bore 118.

A tube 149 projecting through the upper part 151 of the stationary plate 58 is connected to a component 154 which is intended to schematically represent a conventional means for supplying under pressure a combustible gas, fluid or atomized liquid through the tube 149 and into the bore 118 of the rotor 32. Within the bore 118, the combustible material mixes with the combustion air passing along the passageway 143 and within the portion 151 of the stationary housing 58, to provide a combustible mixture available at the valve head 112.

Attention is now directed again to the plate 20 and the portions 22 and 24, within which an oil passage is provided, the oil passage communicating with the space 26 around the lower end of the rotor 32. At the outer or remote end of the portion 24 there is provided an oil scoop opening 160, which is spaced from but adjacent the apex of the V-shaped rotating housing member 41. Because of centrifugal force, lubricating oil in the various rotating portions of this engine will tend to collect in the apex of the housing member 41. Because the latter is rotating past a stationary oil scoop opening 160, the opening 160, which opens in the upstream direction with respect to oil movement, will be able to scoop the oil and transmit it along the internal passageway back to the space 26 from where it is available to lubricate the bearings 28 and 30. Appropriate oil passageways may also be provided in the plate 76 to bring oil to the location of the bearing 84.

The engine described herein is intended to operate as a one-stroke, two-cycle engine, in which burned gases are scavenged out of the cylinder by virtue of their pressure and by the pressure of the in-coming unburned combustible mixture as the valve 110 opens. The opening of the valve 110 takes place when the piston 70 is near the bottom of its stroke, i.e. furthest from the axis of the rotor 32. As the piston moves away from the axis of the rotor 32, its inner rim will clear a plurality of ports 163 in the side wall of the sleeve 165 defining the cylinder 67. The ports communicate with an annular chamber 169 surrounding the sleeve 165, and the chamber 169 communicates through one or more radial openings 170 to the space 173 between the plate 39 and the plate 64. This space is open to the atmosphere, thus allowing the burned products of combustion to escape from the engine.

It is to be understood that this engine construction may be utilized either with spark firing or diesel firing. For simplicity, neither a spark plug nor a glow-plug has been illustrated, however conventional technology is available to power either of these ignition means within the cylinders, even though the cylinders are defined in a rotating member (the rotor 32).

Figure 1B:
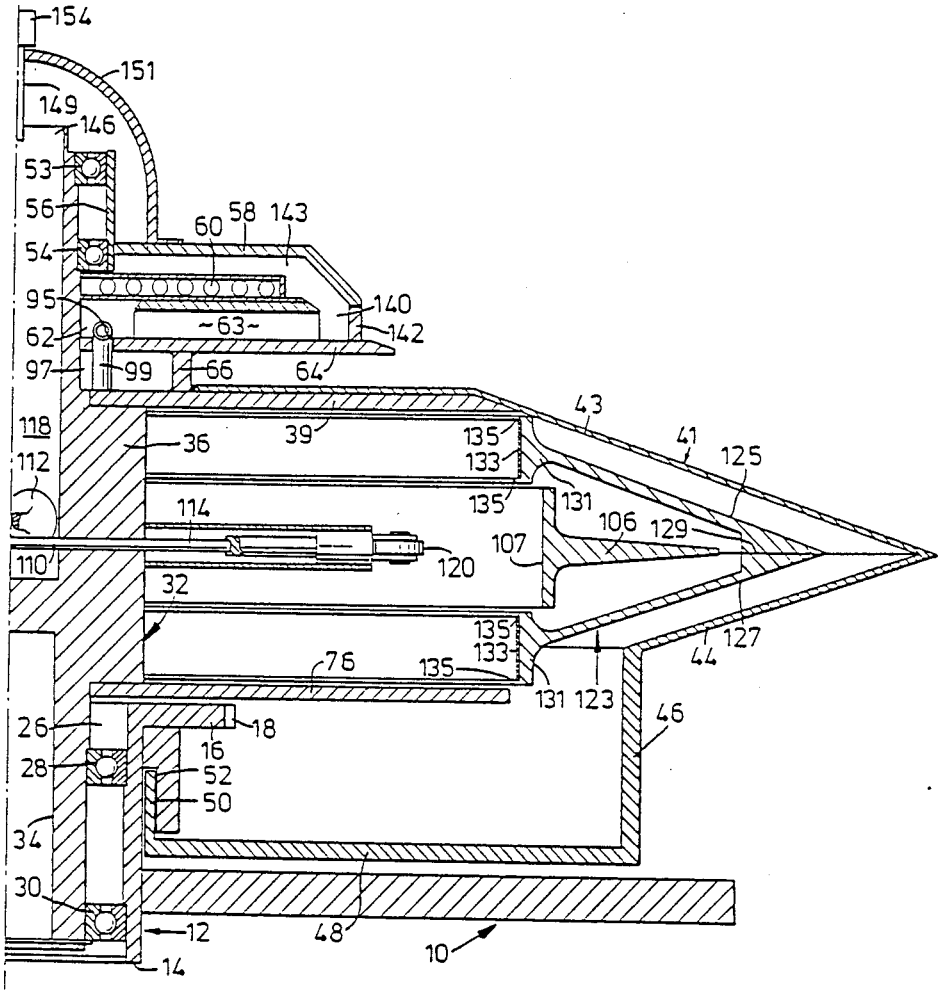

It will be appreciated, from a consideration of the construction that has been described with respect to FIGS. 1*a* and 1*b*, that each of the cylinders describes a substantially circular orbit which is eccentric with respect to the axis of the sun gear. Moreover, all of the cylinders describe precisely the same orbit, which means that there is within the engine, a distributed mass which follows an eccentric orbit. The eccentric portions of the crankshafts also move generally in an eccentric orbit with respect to the axis of the sun gear.

Because the rotor 32 is itself rotating at uniform speed about the axis of the sun gear, and because the rotor 32 contains the cylinders in which the pistons move, it will be appreciated that the angular momentum of the pistons when they are located at their furthest point with respect to the sun gear axis must be considerably greater than their angular momentum when they are at their closest approach to the sun gear axis. This is to be contrasted with the motion of planets or satellites about a main body, for example the eccentric orbit of Mars with respect to the sun. In the latter case, in accordance with the Kepplerian laws, the planet moves more slowly at its aphelion (furthest displacement from the sun), than it does at its perihelion. In the case of the present engine, the fact that the rotor rotates at a uniform speed about the sun gear axis causes a reversal of this phenomenon: the tangential speed of each piston measured linearly at its furthest displacement from the sun gear axis is greater than the tangential speed at its closest approach to the sun gear axis, by an amount which is proportional to the ratio of the distances at furthest and closest approach. Thus, the cylinder must have a markedly greater degree of angular momentum at its furthest distance from the sun gear axis than it does at its closest approach.

It is believed that it is this increase in angular momentum which results in an internally generated net force on the engine perpendicular to its main axis, i.e. the axis of the sun gear. This net force will be directed toward the location on the piston orbit which is furthest from the sun gear, since that is the location where angular momentum is at its peak.

Figure 2:
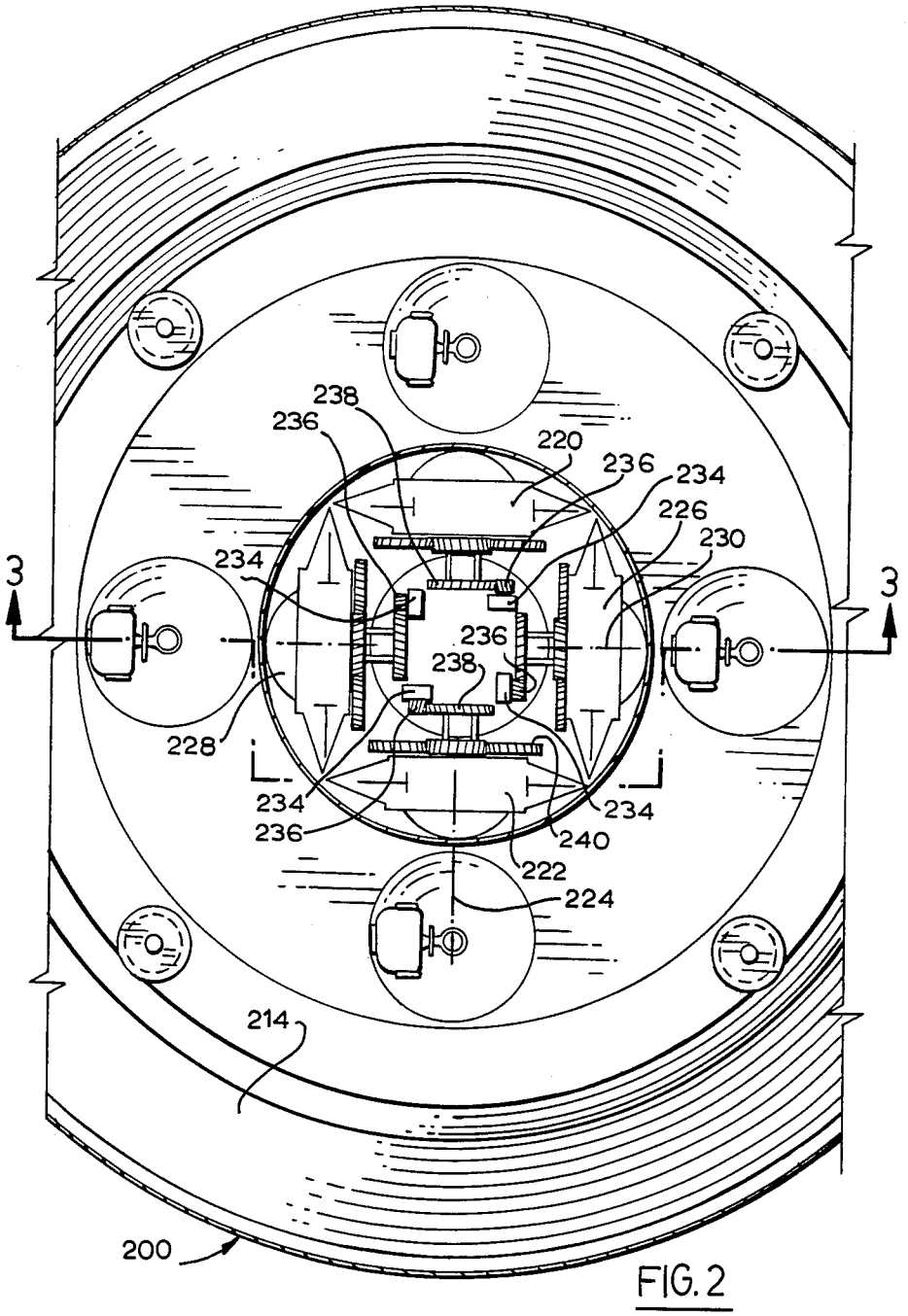

By arranging four of these engines in the configuration shown in FIG. 2, with the piston orbit arranged such that each piston is at the top when it is furthest from the sun gear axis, the net force on each engine will be generally upwardly, thus producing lift for the vehicle.

Figure 3:
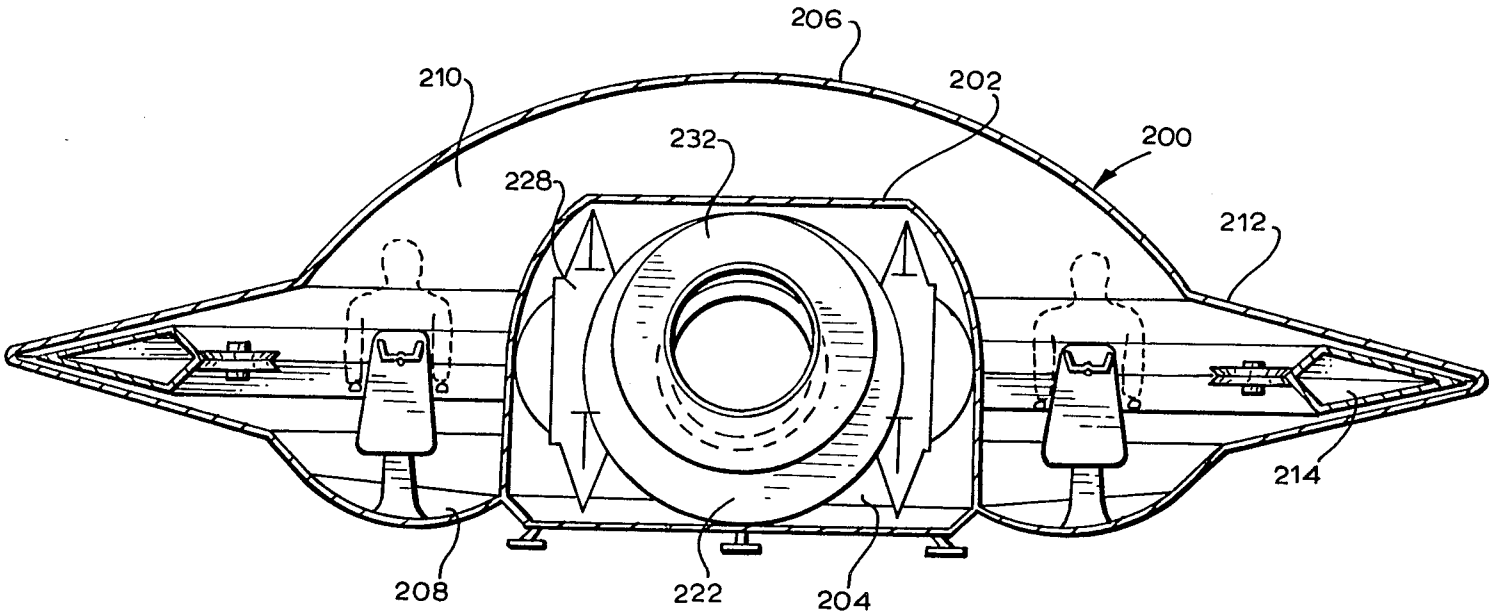

Turning to FIGS. 2 and 3, a self-propelled vehicle 200 includes an enclosure 202 defining an engine chamber 204. An upper, part-spherical wall 206 and an annular floor 208 define around the enclosure 202 a space 210 where passengers may sit or stand. Radially projecting outwardly around the rim of the vehicle 200 is a V-shaped flange 212 which is hollow and which supports for rotation a gyroscopic stabilizing ring 214. The ring 214 is supported for rotation by conventional bearings or similar structures (not shown).

It will be seen in FIG. 2 that the four engines are distributed in two pairs, with the engines of each pair having their general central axes coaxial, and at right angles to the engines of the other pair. More specifically, in FIG. 2 engines 220 and 222 have a common axis 224, while engines 226 and 228 have a common axis 230 which is at right angles to the axis 224.

As can be seen in FIG. 3, the general orbit 232 of the pistons of the engine 222 is eccentric with respect to the axis 224, in such a way that the furthest point on the orbit 232 from the axis 224 occurs near the top.

Means are provided to adjust the angle of this furthest point on the orbit 232, and thereby alter the direction of the thrust or force which the engine generates. In FIG. 2, this means includes a small servomotor 234 for each engine, the servomotor controlling a pinion 236 which controls a larger gear 238, which meshes with an even larger gear 240 that is directly connected to the sun gear of each respective engine. It will be appreciated that controlled rotation of the sun gear of one of these engines will shift by the same amount the point on the piston orbit which is furthest from the sun gear axis.

Referring to FIG. 3, it will now be understood that the lift produced by the engine 222 when the orbit 232 is in the position shown in FIG. 3 can be altered to provide lateral motion as well by moving the point of the orbit 232 that is furthest from the axis 224 through an angle so that it is oblique to the vertical.

By controlling all four of the engines in this manner, any combination of lifting force and sideways propulsion can be attained.

While one embodiment of this invention has been illustrated in the accompanying drawing and described hereinabove, it will be evident to those skilled in the art that changes and modifications may be made therein without departing from the essence of this invention, as set forth in the appended claims.

What I claim is:

1. A self-propelled vehicle which includes a body and a set of four internal-force generating devices, each said device having a central axis about which internal portions thereof rotate, the four devices being configured as two opposed pairs, the two devices of one pair having parallel axes but turning in opposite directions, the two devices of the other pair also having parallel axes but turning in opposite directions, the axes of said one pair being at right angles to the axes of said other pair, each device comprising:

stationary frame means, a stationary sun gear on the frame means, the sun gear being coaxial with the central axis of its respective device, a rotor pivoted about the axis of the sun gear, three crankshafts carried by the rotor at substantially 120° intervals, each having an eccentric portion, for each crankshaft a cylinder in the rotor, a piston mounted for reciprocation in each cylinder, and a connecting rod from the piston to the eccentric portion of the crankshaft, each crankshaft being fixed to rotate with a respective planetary gear, all planetary gears meshing with the sun gear and having the same pitch diameter as the sun gear, whereby any point on the pitch circle of a planetary gear describes a cardioid as the planetary gear rotates around the sun gear once, the crankshaft eccentricity being substantially $\frac{1}{3}$ of the pitch radius of a planetary gear, fuel metering means for providing a combustible mixture for the cylinder, ignition means to ignite the combustible mixture in each cylinder, and valve means for admitting the combustible mixture to, and exhausting combustion gases from, each cylinder.

2. The combination claimed in claim 1, in which the central axes of the two devices for each said pair are coaxial.

3. The combination claimed in claim 1, in which the said eccentric portion of each crankshaft has roller means rotatable about the same axis as the connection between the connecting rod and the eccentric portion, each device further including a ring member having an internal surface surrounding and contacting all of the roller means simultaneously, the ring member being free to rotate about its own axis.

4. The combination claimed in claim 3, in which the central axes of the two devices for each said pair are coaxial.

5. The combination claimed in claim 3, in which each crankshaft has connected to it two drum members each with an outer surface, each said device further including a further ring member concentric with the rotor axis and free to rotate, the further ring member having internal surfaces in contact with the outer surfaces of the drum members, whereby rotation of the rotor causes rotation at a faster speed of said further ring member, and whereby the further ring member functions to absorb at least part of the centrifugal load arising from the pistons and connecting rods.

6. The combination claimed in claim 5, in which each piston lies between its respective crankshaft and the axis of the respective sun gear.

7. The combination claimed in claim 2, in which each device further includes a stationary housing surrounding the rotor of that device and surrounding said further ring member of that device.

8. The combination claimed in claim 5, in which said device further includes air cooling passages adjacent the portions of the respective rotor defining the cylinders, and means for forcing air through said passages.

9. The combination claimed in claim 5, in which the internal surfaces of both ring members of each device are cylindrical.

10. The combination claimed in claim 5, in which each device includes an additional freely rotating ring member having external retaining contact with portions of all the respective planetary gears, thereby to relieve the gear mounts of centrifugal loading.

11. The combination claimed in claim 9, in which the first-mentioned ring member of each device has a T-shaped radial section, the stem of the T extending away from the axis of the sun gear.

12. The combination claimed in claim 11, in which the further ring member of each device has a V-shaped radial section, the apex of the V extending away from the axis of the sun gear.

* * * * *